US010688650B2

(12) United States Patent
Feaver

(10) Patent No.: US 10,688,650 B2
(45) Date of Patent: Jun. 23, 2020

(54) CHAIN STORAGE SYSTEM

(71) Applicant: Al Feaver, Marion, OH (US)

(72) Inventor: Al Feaver, Marion, OH (US)

( * ) Notice: Subject to any disclaimer, the term of this patent is extended or adjusted under 35 U.S.C. 154(b) by 0 days.

(21) Appl. No.: 16/509,697

(22) Filed: Jul. 12, 2019

(65) Prior Publication Data

US 2020/0016738 A1 Jan. 16, 2020

Related U.S. Application Data

(60) Provisional application No. 62/696,911, filed on Jul. 12, 2018.

(51) Int. Cl.

| | |
|---|---|
| ***B65D 85/00*** | (2006.01) |
| ***B25H 3/02*** | (2006.01) |
| ***B27B 17/00*** | (2006.01) |

(52) U.S. Cl.

CPC ..... *B25H 3/02* (2013.01); *B27B 17/00* (2013.01)

(58) Field of Classification Search

CPC ..... A45C 11/04; A45C 11/26; B25H 3/00; B25H 3/003; B25H 3/006; B25H 3/02; B27B 17/00; B27B 17/0008; B65D 25/10; B65D 85/00; B65D 73/00; B65D 73/0014

USPC ..... 206/6.1, 349, 372–379

See application file for complete search history.

(56) References Cited

U.S. PATENT DOCUMENTS

| | | | | |
|---|---|---|---|---|
| 4,260,004 | A * | 4/1981 | Domke | A45C 11/38 190/110 |
| 6,012,571 | A * | 1/2000 | LaPierre | A45C 11/16 206/348 |
| 9,346,608 | B2 * | 5/2016 | Sublett | B65D 85/00 |
| 2004/0069668 | A1 * | 4/2004 | Finnigan | B25H 3/003 206/372 |
| 2005/0139499 | A1 * | 6/2005 | Flynn | B25H 3/006 206/349 |
| 2009/0314674 | A1 * | 12/2009 | Sauerheber | B25H 3/006 206/373 |

* cited by examiner

*Primary Examiner* — Bryon P Gehman

(74) *Attorney, Agent, or Firm* — Jacob M. Ward; Ward Law Office LLC

(57) ABSTRACT

A chain storage system includes a main body, a first holder, and a second holder. The main body has an outer surface and an inner surface with an elongate channel formed therethrough. The channel has a first end and a second end. The first holder is fixedly attached to the main body and spaced apart from the first end of the channel. The second holder is selectively movably disposed in the channel between the first end and the second end. The first holder and the second holder are together configured to receive and secure a chain to the main body. The second holder is movable to accommodate different lengths of the chain.

18 Claims, 5 Drawing Sheets

CHAIN STORAGE SYSTEM

CROSS-REFERENCE TO RELATED APPLICATIONS

This application claims the benefit of U.S. Provisional Application No. 62/696,911, filed on Jul. 12, 2018. The entire disclosure of the above application is hereby incorporated herein by reference.

FIELD

The present disclosure relates to chain storage and, more particularly, to storage of chains for chainsaws.

BACKGROUND

Chains can be used for a multitude of different applications. Common applications involving chains include, but are not limited to: chainsaws, bikes, and conveyor systems. In operation, most chains need to be replaced or substituted after a period of use. For example, chainsaw chains eventually become dull or worn out from use.

Due to this regular need to replace worn chains, spare chains are often stored for convenient use as needed. Moreover, some applications require different types of chains or chains of different sizes that also need to be stored. For example, different chainsaws may require differently sized chains, or chains may have different teeth for specific cutting applications.

These spare chains can become tangled and damaged during storage. For example, spare chainsaw chains are often stored unsecured in the same case as the chainsaw. This can lead to damage from the chains being moved around during transport, and difficulty in separating the chains when they are to be used. In some cases, spare chains are exposed to the environment such as when often left uncontained in truck beds or at work sites. This poor storage can also lead to damage due to exposure from environmental factors such as rain.

There is a continuing need for a storage system and method for securely storing chains while minimizing entanglement and damage. Desirably, the storage system and method can store both multiple chains and chains of different lengths.

SUMMARY

In concordance with the instant disclosure, a storage system and method for securely storing chains while minimizing entanglement and damage, and which can store both multiple chains and chains of different lengths, has been surprisingly discovered.

In one embodiment, a chain storage system includes a main body, a first holder, and a second holder. The main body has an outer surface and an inner surface with an elongate channel formed therethrough. The channel has a first end and a second end. The first holder is fixedly attached to the main body and spaced apart from the first end of the channel. The second holder is selectively movably disposed in the channel between the first end and the second end. The first holder and the second holder are together configured to receive and secure a chain to the main body. The second holder is movable to accommodate different lengths of the chain.

In another embodiment, the inner surface of the main body further has an elongate raised portion. The elongate raised portion defines an associated elongate recessed portion of the outer surface. The channel is formed through the raised portion from the inner surface to the outer surface. The channel has a channel length and the raised portion has a raised portion length, and the channel length is less than the raised portion length. The main body is one of attached to and co-formed with a carrying case. The carrying case having a case handle portion. The first holder includes a first roller and a first shaft. The first shaft is disposed through the first roller and through a hole formed in the raised portion. The hole is spaced apart from the first end of the channel. The first shaft connects the first roller to the main body. The first roller is rotatable on the first shaft. The first roller includes a plurality of spaced apart first gaps. Each of the first gaps configured to receive a first portion of the chain. The second holder includes a second roller and a second shaft. The second shaft is disposed through the second roller and through the channel. The second roller is rotatable on the second shaft. The second roller includes a plurality of spaced apart second gaps. Each of the second gaps configured to receive a second portion of the chain. The second shaft has a shaft head with a rectilinear portion and a base portion. The rectilinear portion is disposed within the channel and militates against a rotation of the second shaft. The base portion has a perimeter edge that circumscribes the rectilinear portion. The base portion is disposed adjacent the outer surface. The second shaft is threadably attached to a second knob disposed adjacent to the second roller. Upon a loosening of the second knob, the second roller may be moved between the first end and the second end of the channel. Upon a tightening of the second knob, the second roller may not be moved between the first end and the second end of the channel. A lid is also hingedly attached to the carrying case and movable between an open position and a closed position. The lid, in the closed position, is configured to fully enclose the chain of the chainsaw upon being received and secured by the first holder and the second holder. The lid further has a lid handle portion. Where the lid is in the closed position, the lid handle portion cooperates with the case handle portion to define a handle for carrying the chain.

In a further embodiment, a method for storing the chain, such as a chain for a chainsaw, includes the steps of providing both the chain storage system and the chain having a first portion and a second portion. The first portion of the chain is then disposed on the first holder, and the second portion of the chain is disposed on the second holder. The second holder in the channel is then moved until the chain is pulled taut between the first holder and the second holder. The second holder is then selectively affixed to the main body to thereby secure the chain. This method may be completed with multiple chains, of the same or different lengths, in order to minimize both the entanglement and damage to the chains during storage and transport of the chain storage system.

In an exemplary embodiment, a chain storage system is configured to secure chains of varying lengths or sizes. The storage system has a hollow main body with a handle. The chain storage system may further have a lid that is configured to close the main body to secure the contents of the same for storage and transport.

The main body may be made of a variety of materials. For example, the main body may be made of a thermoplastic material such as polypropylene or polyethylene. Where the thermoplastic material is used, the main body may be formed by an injection molding process, as a non-limiting example. One of ordinary skill in the art may select other suitable materials and methods for manufacturing the main body within the scope of the present disclosure.

A plurality of channels are formed within the main body. Each channel is configured to receive a holder. In certain embodiments, a first holder is attached to the main body in a fixed position on the main body, and a second holder is received by and selectively movable along a length of one of the channels. It should be appreciated that the main body may have any combination of channels and holders as desired.

Furthermore, the first and second holders may be any suitable shape as chosen by a skilled artisan. The main body may also be configured to hold a plurality of tools using a clamp or a recess of predetermined size and shape, for the convenience of the user.

The second holder may have a head portion that has a diameter greater than a width of the channel. The head portion is disposed on an exterior surface of the main body. The second holder may also be threadedly attached to a handle body such as a knob. The handle body is movable along the length of the channel along with the second holder. For example, the second holder may have a threaded base that is configured to receive the handle body.

In operation, where the handle body is tightened, the head portion of the handle body may be caused to abut the exterior surface of the main body, and thereby selectively affix the second holder to main body at a desired location along the length of the channel. When the handle body is loosened, the head portion of the handle body may be caused to move away from the exterior surface of the main body, and thereby permit the second holder to be manually moved or repositioned along the length of the channel by the user. In this manner, it should be appreciated that the positioning of the movable second holder relative to the permanently affixed first holder allows the user to secure chains of different sizes within the same main body.

Additionally, although the threaded handle body is described as one particular means to secure the second holder along the length of the channel, any other suitable securing means may be used to selectively affix the second holder to the main body at different locations along the length of the channel. As non-limiting examples, the second holder may be secured by a fastening assembly, a latch, an adhesive, a clamp, a clip, hook and loop fasteners, or magnets. Other suitable securing means may also be employed, as desired.

In some examples, the first and second holders may each have a bulged outer portion and narrow middle portion. The bulged outer portion militates against the chain accidently disconnecting from the first and second holders. The first and second holders thereby secure the chain between the main body of the storage system and the bulged outer portion.

In other examples, each of the first and second holders may have a plurality of protrusions configured to fit within the gaps of the chain. For example, the holders may be sprocket-shaped, and are configured to militate against inadvertent disconnection of the chain from the holders.

In operation, a user will place one end of a chain so that it abuts the first holder. The user will then move the second holder within the channels in the main body until the first holder and of the second holder each are abutting the inside portion of the chain. The second holder is then moved until the chain is taut or tensioned. The handle body is then tightened, securing the second holder to the main body. The tension in the chain is created by the first holder being spaced apart a sufficient distance from the second holder, and secures the chain to the main body.

In certain examples, there may be three channels to secure three separate chains of either the same or varying dimensions to the main body. In a most particular embodiment, the first holder and second holder are configured to secure chains having length of 14" and 24", as non-limiting examples. It should be understood that any other suitable length of chainsaw chain may also be accommodated by the storage system of the present disclosure.

In a further example, each set of first holder and second holder may secure a plurality of chains, and not just a single chain. Each of the first holder and the second holder may be of a sufficient length or height in order to hold these multiple chains. The lengths or heights of the first and second holders may be selected by one of ordinary skill in the art, as desired.

Although the system and method of the present disclosure is described hereinabove primarily with respect to chainsaw chains, it should be appreciated that other types of chains and belts may likewise be secured within the main body of the storage system. For example, bike chains, drive chains, roller chains, or any other type of chain or belt may be stored within the scope of the present disclosure, as desired.

Further areas of applicability will become apparent from the description provided herein. It should be understood that the description and specific examples are intended for purposes of illustration only and are not intended to limit the scope of the present disclosure.

DRAWINGS

The above, as well as other advantages of the present disclosure, will become readily apparent to those skilled in the art from the following detailed description, particularly when considered in the light of the drawings described herein.

Figure 1:
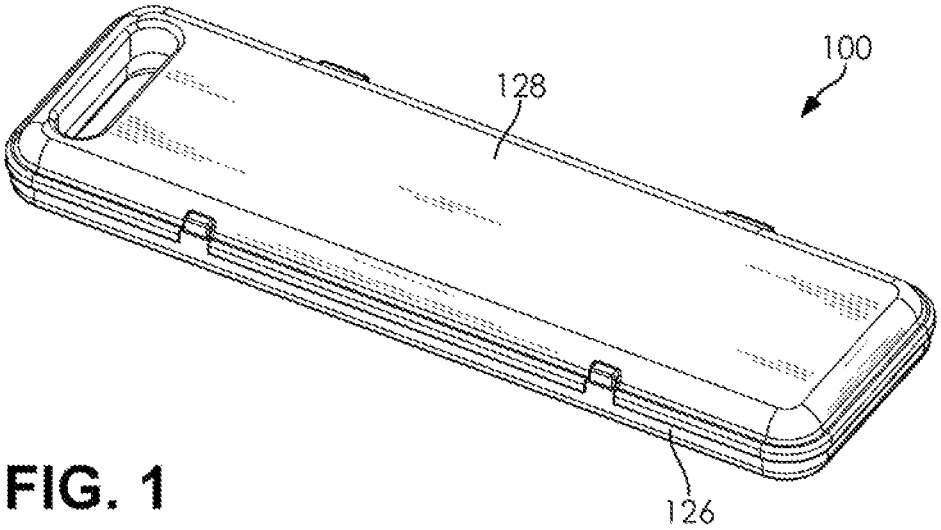
FIG. 1 is a top perspective view of a carrying case for a chain storage system according to one embodiment of the present disclosure.
Figure 2:
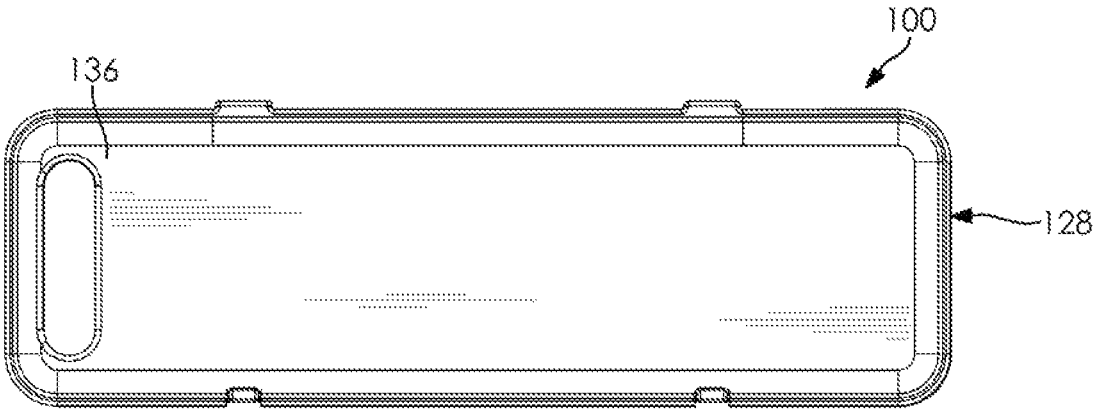
FIG. 2 is a top plan view of the carrying case shown in FIG. 1.
Figure 3:
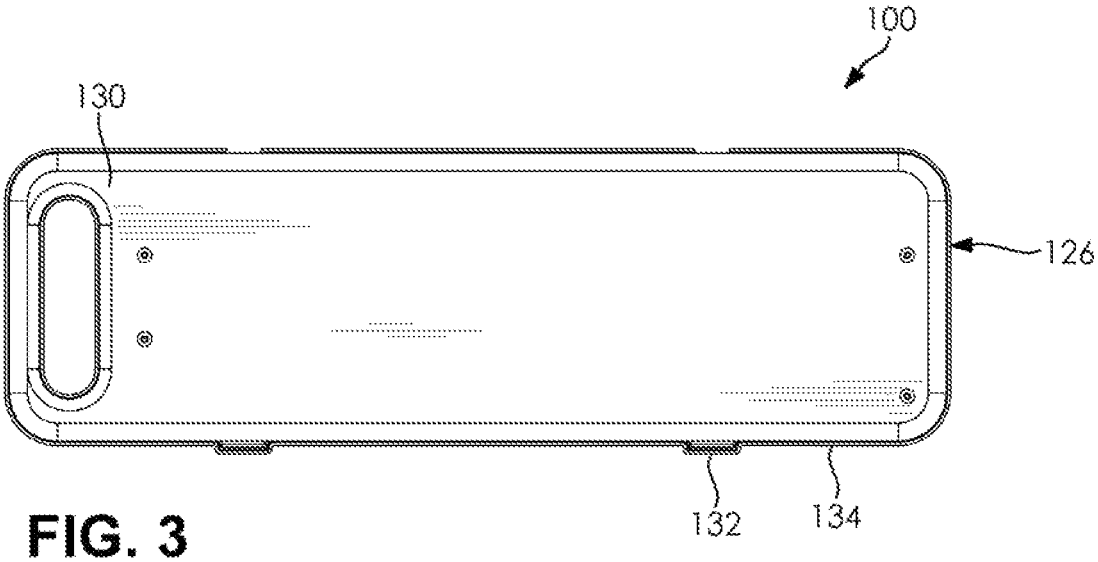
FIG. 3 is a bottom plan view of the carrying case shown in FIG. 1.
Figure 10:
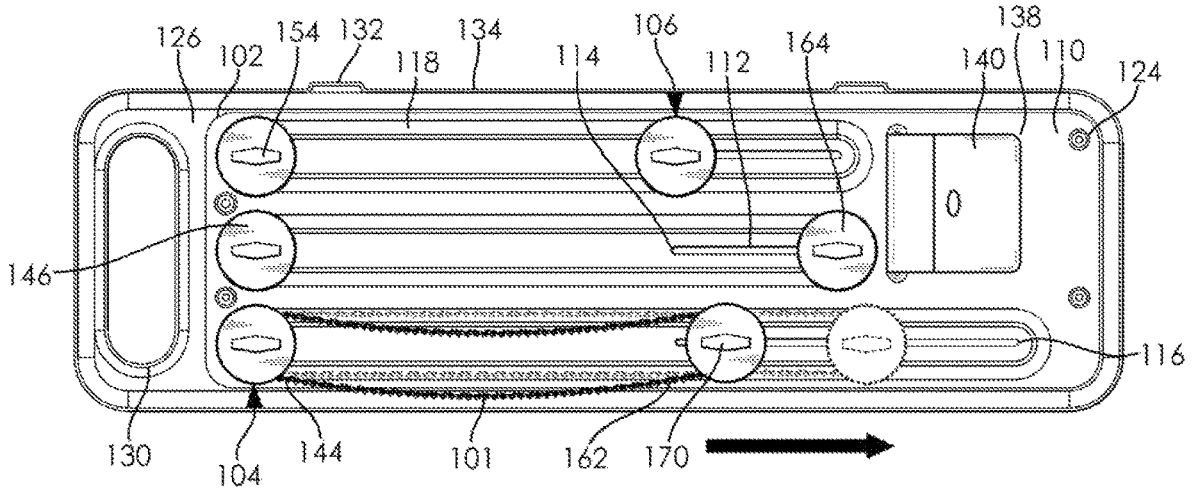
Figure 11:
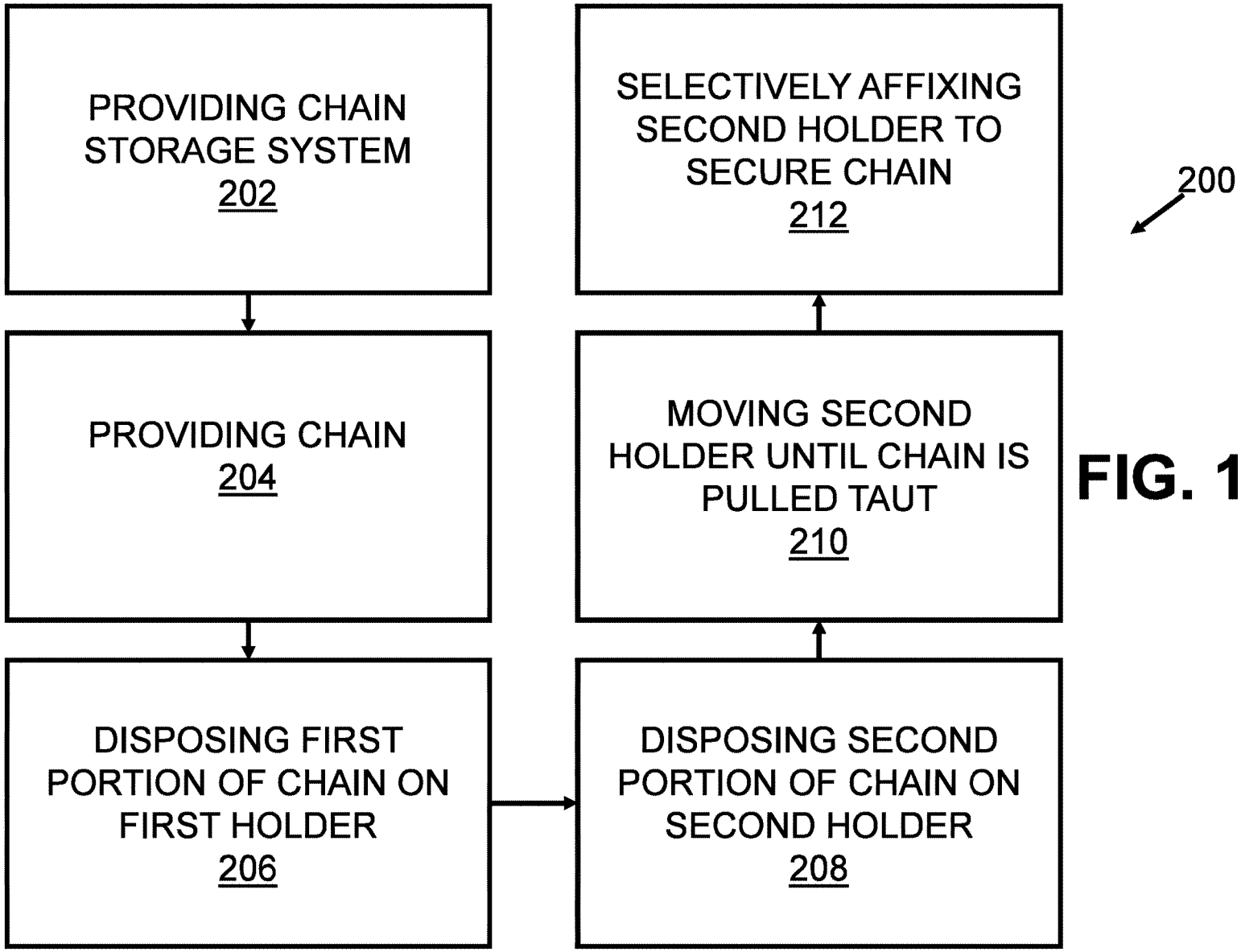

FIG. 10 is a top plan view of the chain storage system disposed in the carry case shown in FIGS. 1-3 according to one embodiment of the present disclosure, and further illustrating a movement of one of the holders to secure a chain to the chain storage system; and FIG. 11 is a flowchart illustrating a method for storing chains, such as chainsaw chains, according to one embodiment of the present disclosure.

DETAILED DESCRIPTION

The following detailed description and appended drawings describe and illustrate various embodiments of the invention. The description and drawings serve to enable one skilled in the art to make and use the invention and are not intended to limit the scope of the invention in any manner. In respect of the methods disclosed, the order of the steps presented is exemplary in nature, and thus, is not necessary or critical unless otherwise disclosed.

As shown in FIGS. 1-10, a chain storage system 100 is configured to secure and hold one or more chains 101 (shown in FIG. 10) of various sizes or lengths. For example, as illustrated in FIGS. 6-10, the chain storage system 100 may have a main body 102, a first holder 104, and a second holder 106. The main body 102 has an outer surface 108 and an inner surface 110. An elongate channel 112 is formed through the outer and inner surfaces 108, 110.

Although the structure of the chain storage system 100 is described largely herein with respect to the cooperation of single ones of the first holder 104, the second holder 106, and the elongate channel 112, for purposes of illustration, it should be appreciated that the chain storage system 100 may also have a plurality of channels 112, each of which has a corresponding one of a plurality of first holders 104 and a corresponding one of a plurality of second holders 106 associated therewith. The employment of multiple first and second holders 104, 106 and elongate channels 112 advantageously allows for the storage of multiple chains 101 and, depending on the arrangement as described further herein, chains 101 of different dimensions. One skilled in the art may select any suitable number of the first holder 104, the second holder 106, and the channel 112, as desired.

The main body 102 may be formed from a rigid material that is weather-resistant. Non-limiting examples of suitable materials may include plastic, such as polyethylene or polypropylene, or metals, such as steel. Composite materials are also contemplated and may be used. The main body 102 may be formed by any suitable manufacturing process, including injection molding, rotational molding, and stamping. A person skilled in the art may also select other suitable materials and manufacturing processes for the main body 102 within the scope of the present disclosure.

The size and shape of the main body 102 may vary depending on the type and amount of chains 101 desired to be stored. For example, a 20-inch chain 101 may require a main body 102 of at least 2 feet lengthwise. It should be appreciated that the dimensions of the main body 102 are scalable by one skilled in the art according to the size and type of the chains 101 to be stored.

Figure 6:
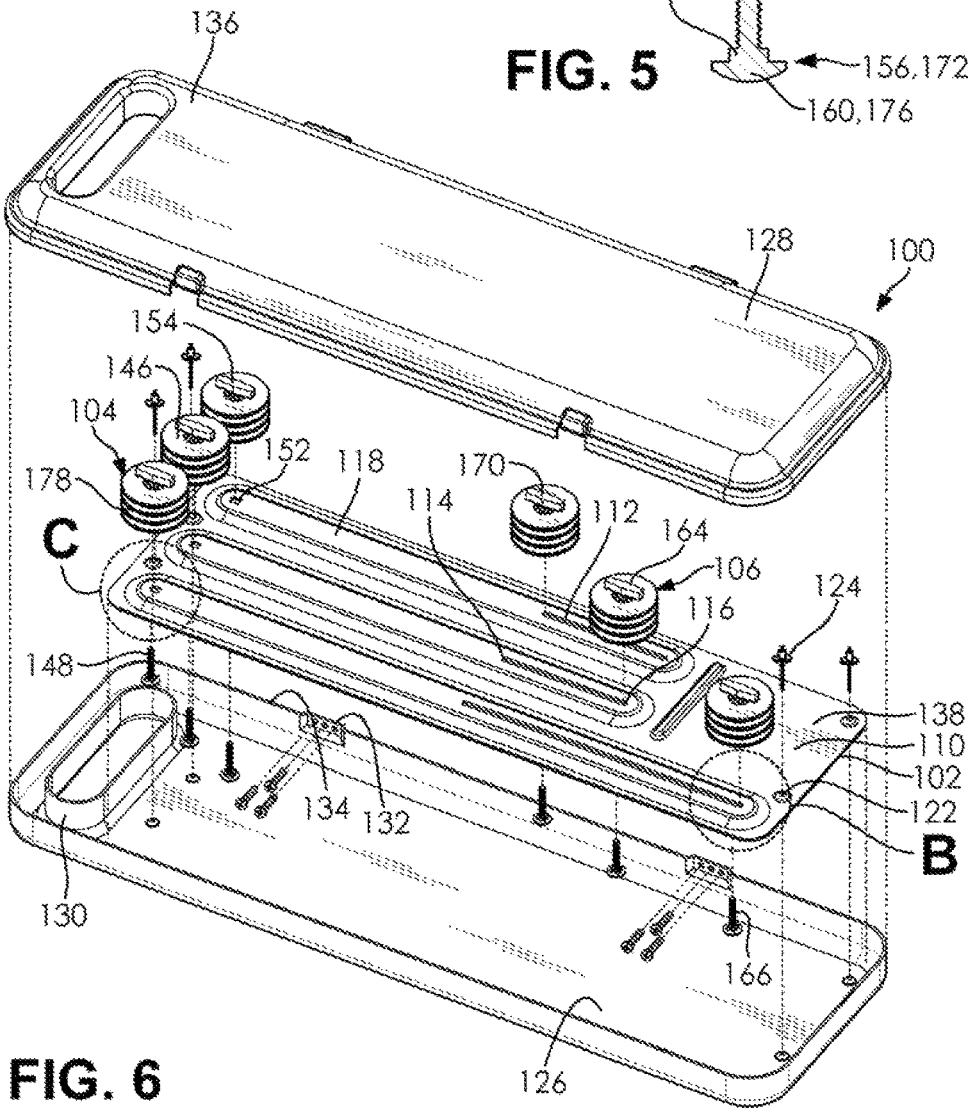
FIG. 6 is an exploded top perspective view of the chain storage system within the carrying case shown in FIGS. 1-3, according to one embodiment of the present disclosure.

As shown in FIGS. 6 and 10, the channel 112 has a first end 114 and a second end 116. In operation, and discussed in further detail below, the channel 112 allows for the chain system 100 to accommodate a variety of the chains 101 of different lengths. The length and position of the channel 112 may be dictated by the length of the longest chain 101 that is desired to be stored. A skilled artisan may select different positions and lengths of the channel 112 to accommodate different chain 101 lengths within the scope of the present disclosure.

Figure 7:
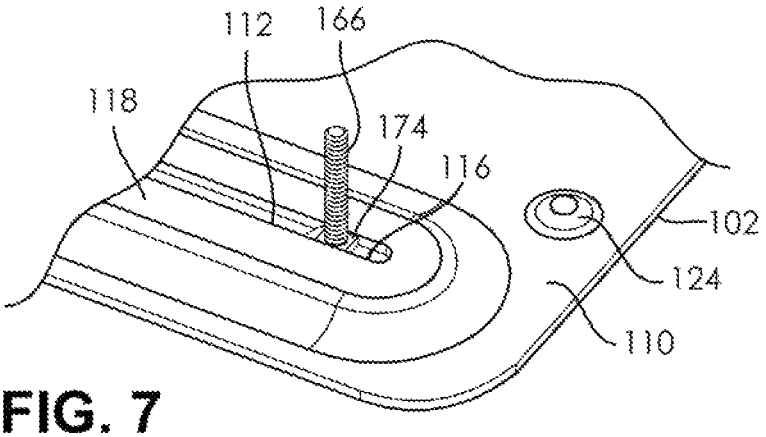
FIG. 7 is an enlarged fragmentary top perspective view of the chain storage system taken at call-out B in FIG. 6, and further illustrating a cooperation of a rectilinear portion of a shaft head of a holder and a channel formed in the chain storage system.
Figure 8:
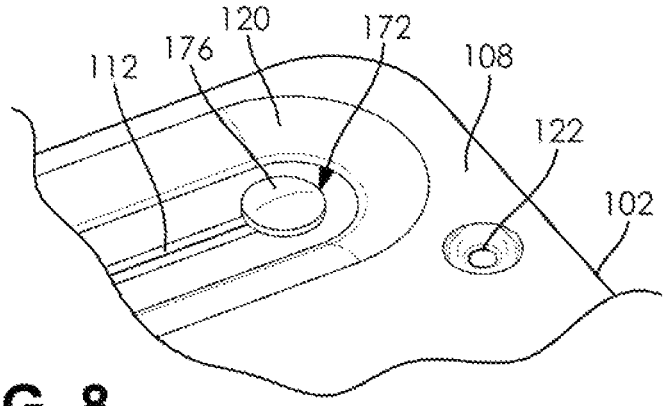
FIG. 8 is an enlarged fragmentary bottom perspective view of the chain storage system taken at call-out B in FIG. 6, and further illustrating the cooperation of the shaft head and the channel formed in the chain storage system.

As shown in FIGS. 6-7 and 10, the chain storage system 100 may further include an elongate raised portion 118, which is arranged along a length of the main body 102. The elongate raised portion 118 may extend outwardly from the inner surface 110 of the main body 102. The raised portion 118 may likewise define an associated elongate recessed portion 120 on the outer surface 108, as shown in FIG. 8.

In particular embodiments, the channel 112 is formed through the raised portion 118 from the inner surface 110 to the outer surface 108. The length of the channel 112 is less the than a length of the raised portion 118 with which the channel 112 is associated. It should be appreciated that the recessed portion 120 provides space for positioning of shaft heads 160, 176 (shown in FIG. 8) of the holders 104, 106, so that the shaft heads 160, 176 are disposed under a plane defined by the outer surface 108 of the main body 102. This allows the main body 102 to be positioned and remain substantially level on an inner surface of a carrying case 126, as described further herein.

With reference to FIGS. 6-10, the main body 102 may further include a plurality of main apertures 122. The main apertures 122 are configured to receive fasteners 124, such as nails, screws, or rivets, which allow the main body 102 to be mounted onto different surfaces such as the inner surface of the carrying case 126. Other nonlimiting examples of surfaces for mounting the main body 102 include walls and workstations. One skilled in the art may also select other suitable mounting surfaces, as desired.

As shown in FIGS. 1-3, 6, and 10, and as previously described, the chain storage system 100 may further include the carrying case 126 and a lid 128. The carrying case 126 and the lid 128 may be particularly useful for the transport and storage of the chains 101, as described further herein. The carrying case 126 may be configured to receive the main body 102, or the carrying case 126 may be co-formed with the main body 102.

In a nonlimiting example, the main body 102 is affixed to the carrying case 126 via rivets 124 disposed through the main apertures 122. It should be appreciated that although rivets 124 have been shown to be useful, other types of the fasteners 124 may be selected by a skilled artisan with the scope of the disclosure.

As shown in FIG. 1, the lid 128 is configured to attach to the carrying case 126. For example, the carrying case 126 may include a case handle portion 130 and a plurality of tabs 132, which may be employed in hingedly connecting the lid 128 with the carrying case 126. The lid 128 may have a lid handle portion 136 that is configured to cooperate with the case handle portion 130, where the lid 128 is in a closed position, to thereby define a handle of the carrying case 126. In some examples, the lid 128 is hingedly attached to the carrying case 126 via the plurality of tabs 132 extending out from a lip 134 of the carrying case 126, which in turn are attached to the lid 128 with fasteners, as shown in FIG. 6. It should be appreciated that although the plurality of tabs 132 have been found to be useful for hingedly connecting the lid 128 to the carrying case 126, the lid 128 may be attached to the carrying case 126 using different suitable means by a person skilled in the art.

It should be understood that the hinged connection allows the lid 128 to be selectively moved between an open position and a closed position. The lid 128 is configured to fully enclose the contents of the carrying case 126 wherein in the closed position. As described hereinabove, and shown in FIGS. 1-3, the lid handle portion 136 and case handle portion 130 also align when the lid 128 is in the closed position. Advantageously, this allows the case handle portion 130 and the lid handle portion 136 to together be used as the handle for carrying the chain storage system 100.

With renewed reference to FIGS. 6 and 10, the main body 102 may further include at least one storage area 138 disposed adjacent to either the first end 114 or the second end 116 of the channel 112. The storage area 138 is configured to hold tools and accessories, for example, chain oil containers, wrenches, and the like. In some examples, as shown in FIG. 10, the storage area 138 includes a bag 140 that attached to the main body 102 at the storage area 138. The bag 140 may be removably attached to the main body 102 with fasteners, such as hook-and-loop fasteners, for example.

It should be appreciated that the storage area 138 allows the user to securely store the tools and accessories related to the chains 101. In addition, this allows the tools and accessories to be easily retrieved during applications involving the chains 101. A person skilled in the art may add additional recesses, protrusions, or attachments to secure additional tools and accessories to the storage area 138.

With reference to FIGS. 4-6 and 10, the first holder 104 is configured to receive a first portion 144 of the chain 101. The first holder 104 is fixedly attached to the main body 102 and spaced apart from the first end 114 of the channel 112.

In a particular embodiment, the first holder 104 may include a first roller 146, and a first shaft 148. The first roller 146 has a first aperture 150 formed therethrough. The first shaft 148 is disposed through the first aperture 150 and through a hole 152 formed in the raised portion 118 of the main body 102, thereby connecting the first roller 146 to the main body 102. The hole 152 is spaced apart from the first end 114 of the channel 112.

It should be appreciated that a distance between the hole 152 and the first end 114 of the channel 112 directly correlates to the minimum length of the chain 101 that can be stored on the associated first and second holders 104, 106. In other words, the minimum chain 101 that can be stored is the distance between the hole 152 in the main body 102 and the first end 114 of the channel 112.

In certain examples, the first roller 146 is rotatably connected to the main body 102 via the first shaft 148. It should be appreciated that this may facilitate an easier positioning of a first portion 144 of the chain 101 on the first roller 146 in operation.

In other examples, the first shaft 148 is threadably attached to a first knob 154. The first knob 154 is disposed adjacent to the first roller 146. The first knob 154 is configured to tighten or loosen the fixed connection between the first holder 104 and the main body 102. This permits the user to more easily control whether the first roller 146 can be rotated or fixedly disposed on the first shaft 148.

In a particular embodiment, the first shaft 148 may include a first shaft head 156. The first shaft head 156 has a first rectilinear portion 158 and a first base portion 160. The first rectilinear portion 158 is disposed within the hole 152 of the main body 102 upon assembly. Desirably, the shape of the first rectilinear portion 158 corresponds to the shape of the hole 152, thereby militating against an undesirable rotation of the first shaft 156 during a tightening or loosening of the first knob 154. It should be appreciated that the shape of the first rectilinear portion 158 and the hole 152 of the main body 102 can vary as long as they correspond in such a way to militate the rotation of the first shaft 148 in operation.

Figure 9:
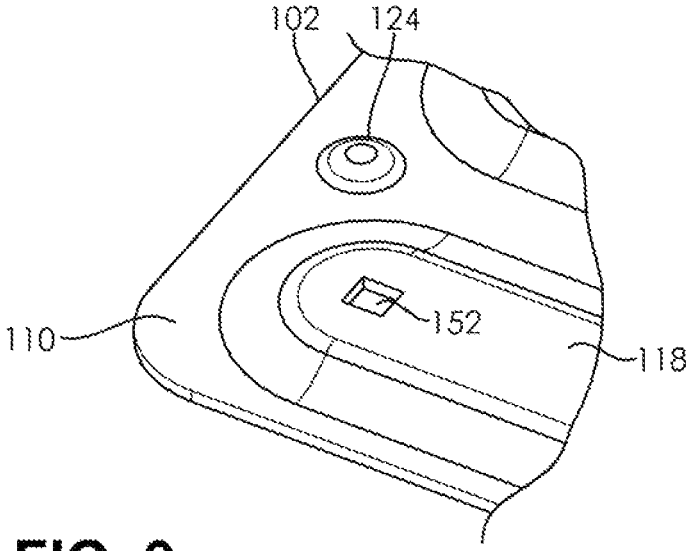
FIG. 9 is an enlarged fragmentary top perspective view of the chain storage system taken at call-out C in FIG. 6, and further illustrating a rectilinear hole for cooperation with the rectilinear portion of the shaft head of the holder, the shaft head of the holder not shown for purposes of illustration.

With reference to FIG. 9, the first base portion 160 of the first shaft head 156 is disposed adjacent to the outer surface 108 of the main body 102. The first base portion 160 has a first perimeter edge that circumscribes the first rectilinear portion 158. The first rectilinear portion 158 is also disposed between the first base portion 160 and the first roller 146.

With renewed reference to FIGS. 4-6 and 10, the second holder 106 is configured to receive a second portion 162 of the chain 101. The second holder 106 is selectively and moveably disposed in the channel 112 between the first end 114 and the second end 116 of the channel 112. Desirably, the second holder 106 is selectively movable along the channel 112 in order to accommodate chains 101 of different lengths.

For example, as shown in FIG. 10, the second holder 106 is moved towards the first end 114 for smaller chains 101 and towards the second end 116 for larger chains 101. As previously mentioned, these distances may be scaled by a skilled artisan according to the minimum and maximum sizes of the chains 101 that are desired to be stored.

Figure 5:
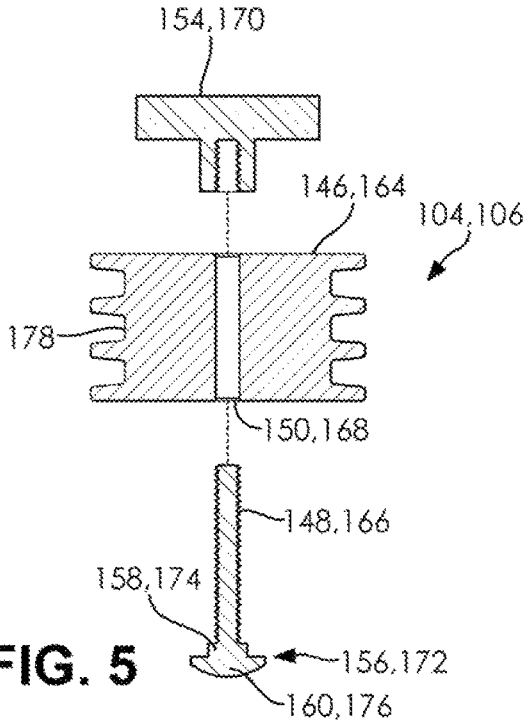
FIG. 5 is a cross sectional view of the holder taken at section line A-A in FIG. 4.

In another embodiment, as also shown in FIG. 5, the second holder 106 includes a second roller 164 and a second shaft 166. The second roller 164 has a second aperture 168 formed therethrough. The second shaft 166 is disposed through the second aperture 168 and through the channel 112, thereby connecting the second roller 164 to the main body 102.

It should be appreciated that, when fixed in place on the main body 102, each of the first roller 146 and the second roller 164 may be free rotating. Free rotation may be permitted by a loose placement in the respective first and second shafts 148, 166, or through the use of bearings or lubricants, as desired. Alternatively, upon being fixed in place, the first roller 146 and the second roller 164 may be caused to no rotate freely, for example, due to friction interference with an outer surface of the main body 102. One skilled in the art may select rotatable or non-rotatable versions of the first and second rollers 146, 164 within the scope of the present disclosure.

In certain examples, the second roller 164 is rotatably connected to the main body 102 via the second shaft 166. It should be appreciated that this may allow the second portion 162 of the chain 101 to be disposed on, or removed from, the second roller 164 in an easier manner.

In other examples, the second shaft 166 is threadably attached to a second knob 170. The second knob 170 is disposed adjacent to the second roller 164. The second knob 170 is configured to be manually loosened or tightened via rotation. Upon being tightened, a movement of the second roller 164 between the first end 114 and the second end 116 of the channel 112 may be militated against.

In a particular embodiment, as also shown in FIG. 5, the second shaft 166 has a second shaft head 172. The second shaft head 172 has a second rectilinear portion 174 and a second base portion 176. The second rectilinear portion 174 is disposed within the channel 112 upon assembly. Advantageously, the second rectilinear portion 174 militates against a rotation of the second shaft 166 during a twisting of the second knob 170, for example, as shown in FIG. 7.

The second base portion 176 is disposed adjacent to the outer surface 108 of the main body 102 upon assembly. The second base portion 176 has a first perimeter edge that circumscribes the second rectilinear portion 174. The second rectilinear portion 174 is also disposed between the second base portion 176 and the second roller 164.

Figure 4:
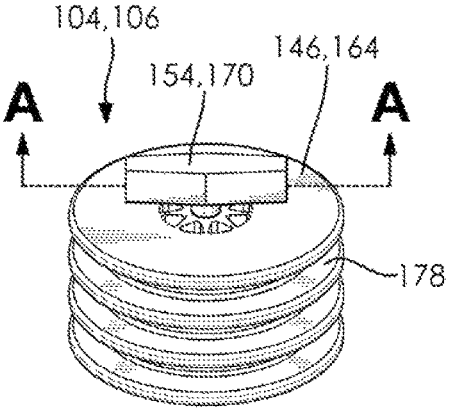
FIG. 4 is a perspective view of a holder for the chain storage system according to one embodiment of the present disclosure.

As shown in FIGS. 4-6, the first holder 104 and the second holder 106 each may further include a plurality of spaced apart gaps 178. Each of the gaps 178 is configured to receive either the first portion 144 or second portion 162 of the chain 101. Advantageously, the plurality of spaced apart gaps 178 allows the first holder 104 and second holder 106 to each simultaneously hold more than one chain 101 of a same or similar length. Also, since each of the gaps 178 is limited to one portion of the chain 101, the first and second portions 144, 162 of different ones of the chains 101 being simultaneously stored do not directly abut against each other. This may minimize an entanglement of the chains 101, and likewise result in less opportunity for damage to the chains 101, which may otherwise be caused by the chains 101 abutting against each other in storage. Likewise, this spacing in storage is believed to increase the lifespan of the chains 101 in operation.

Each of the gaps 178 must have a gap width sufficient to receive a width of the chain 101. In addition, each of the gaps 178 must have an adequate depth to militate against teeth of the chains 101 from digging into and damaging a surface of the roller 146, 164 when being used. In other embodiments, the depth of each of the gaps 178 is greater than the length of the teeth. A skilled artisan may select different dimensions for the gaps 178, in order to accommodate different types of chains 101 such as thicker chains 101 or chains 101 with larger teeth, within the scope of this disclosure.

Referring now to FIG. 11, a method 200 for storing the chain 101 includes a first step 202 of providing the chain storage system 100, and a second step 204 of providing the chain 101 with a first portion 144 and a second portion 162. In a third step 206, the first portion 144 of the chain 101 is disposed on the first holder 104. In a fourth step 208, the second portion 162 of the chain 101 is disposed on the second holder 106. In a fifth step 210, the second holder 106 is moved along the length of the channel 112 in a direction away from the first holder 104, until the chain 101 is pulled taut between the first holder 104 and the second holder 106. Desirably, and as mentioned above, this selective, manual movement of the second holder 106 accommodates chains 101 of different lengths. In a sixth step 212, the second holder 106 is selectively affixed to the main body 102, thereby securing the chain 101 to the main body 102 of the chain storage system 100.

It should be understood that, in operation, the second holder 106 is selectively affixed to the main body 102 by a rotation of the second knob 170. Upon rotating the second knob 170 in one direction, the second base portion 176 is pulled towards the main body 102, thereby squeezing the main body 102 between the second base portion 176 and the second roller 164 to militate against movement of the second roller 164 along a length of the channel 112. Likewise, upon rotating the second knob 170 in an opposite direction, the second base portion 176 is pushed away from the main body 102, thereby releasing the main body 102 from the second base portion 176 and the second roller 164 so that the second roller 164 may be freely moved along the length of the channel 112 to another location.

Advantageously, the chain storage system 100 and the method 200 of the present disclosure have been found to securely store the chains 101, and particularly the chains 101 of chainsaws, while minimizing entanglement and damage of the same. Furthermore, the chain storage system 100 of the present disclosure may be employed to store both multiple ones of the chains 101, as well as the chains 101 of different lengths or dimensions.

While certain representative embodiments and details have been shown for purposes of illustrating the invention, it will be apparent to those skilled in the art that various changes may be made without departing from the scope of the disclosure, which is further described in the following appended claims.

What is claimed is:

1. A chain storage system, comprising:

a main body having an outer surface and an inner surface with an elongate channel formed therethrough, the elongate channel having a first end and a second end;

a first holder fixedly attached to the main body and spaced apart from the first end of the elongate channel; and a second holder selectively movably disposed in the elongate channel between the first end and the second end, the first holder and the second holder together configured to receive and secure a chain to the main body, wherein the main body further has an elongate raised portion on the inner surface, and an elongate recessed portion on the outer surface, the elongate recessed portion disposed opposite the elongate raised portion, the elongate channel formed through the elongate raised portion to the elongate recessed portion, and the main body also has a rectilinear hole formed therethrough from the elongate raised portion to the elongate recessed portion, the rectilinear hole spaced apart from the first end of the elongate channel, wherein the first holder includes a first roller and a first shaft, the first shaft disposed through the first roller and through the rectilinear hole of the main body, and the first shaft connecting the first roller to the main body, the first shaft having a first shaft head with a first rectilinear portion and a first base portion, the first shaft threadably attached to a first knob disposed adjacent to the first roller, and upon tightening of the first knob the first holder is fixedly attached to the main body, and the first rectilinear portion is disposed within the rectilinear hole, thereby militating against a rotation of the first shaft during the tightening or a loosening of the first knob, and the first base portion has a first perimeter edge that circumscribes the first rectilinear portion of the first shaft, the first base portion disposed adjacent to the outer surface of the main body inside of the elongate recessed portion, wherein the second holder includes a second roller and a second shaft, the second shaft disposed through the second roller and through the elongate channel, the second shaft having a second shaft head with a second rectilinear portion and a second base portion, the second rectilinear portion disposed within the elongate channel and militating against a rotation of the second shaft but permitting movement of the second shaft along the elongate channel, and the second base portion having a perimeter edge that circumscribes the second rectilinear portion, the second base portion disposed adjacent the outer surface of the main body and inside of the elongate recessed portion, and the second shaft threadably attached to a second knob disposed adjacent to the second roller, and upon a loosening of the second knob the second roller is movable between the first end and the second end of the elongate channel, and upon a tightening of the second knob the second roller is not movable between the first end and the second end of the elongate channel, whereby the second holder is selectively movable relative to the first holder to accommodate different lengths of the chain.

2. The chain storage system of claim 1, wherein the channel has a channel length and the raised portion has a raised portion length, the channel length being less than the raised portion length.

3. The chain storage system of claim 1, wherein the first roller is rotatable on the first shaft.

4. The chain storage system of claim 1, wherein the first roller includes a plurality of spaced apart first gaps, each of the first gaps configured to receive a first portion of the chain.

5. The chain storage system of claim 1, wherein the second roller is rotatable on the second shaft.

6. The chain storage system of claim 1, wherein the second roller includes a plurality of spaced apart second gaps, each of the second gaps configured to receive a second portion of the chain.

7. The chain storage system of claim 1, wherein the main body further has at least one storage area configured to receive tools and accessories, the storage area disposed adjacent the second end of the channel.

8. The chain storage system of claim 7, further comprising a bag attached to the main body at the storage area for holding the tools and accessories.

9. The chain storage system of claim 1, wherein the main body is one of attached to and co-formed with a carrying case, the carrying case having a case handle portion.

10. The chain storage system of claim 9, further comprising a lid hingedly attached to the carrying case and movable between an open position and a closed position, the lid in the closed position configured to fully enclose the chain upon being received and secured by the first holder and the second holder.

11. The chain storage system of claim 10, wherein the lid further has a lid handle portion, the lid handle portion cooperating with the case handle portion to define a handle for carrying the chain where the lid is in the closed position.

12. The chain storage system of claim 1, wherein the first rectilinear portion of the first shaft head is disposed between the first base portion and a first threaded shaft portion of the first shaft.

13. The chain storage system of claim 12, wherein the first rectilinear portion of the first shaft head has a first rectilinear width, the first base portion of the first shaft head has a first base width, and the rectilinear hole has a hole width, and the first base width is greater than the first rectilinear width and the hole width, and the first rectilinear width is less than the hole width.

14. The chain storage system of claim 13, wherein an outside surface of the first rectilinear portion abuts an inside surface of the rectilinear hole, thereby providing a friction fit between the first rectilinear portion of the first shaft and the rectilinear hole of the main body.

15. The chain storage system of claim 1, wherein the second rectilinear portion of the second shaft head is disposed between the second base portion and a second threaded shaft portion of the second shaft.

16. The chain storage system of claim 15, wherein the second rectilinear portion of the second shaft head has a second rectilinear width, the second base portion of the second shaft head has a second base width, and the elongate channel has a channel width, and the second base width is greater than the second rectilinear width and the channel width, and the second rectilinear width is less than the channel width.

17. The chain storage system of claim 16, wherein an outside surface of the second rectilinear portion slidably abuts an inside surface of the elongate channel, thereby permitting for selective movement of the second rectilinear portion of the second shaft along the elongate channel.

18. A method for storing a chain, the method comprising steps of:

providing a chain storage system including a main body having an outer surface and an inner surface with an elongate channel formed therethrough, the elongate channel having a first end and a second end, a first holder fixedly attached to the main body and spaced apart from the first end of the elongate channel, and a second holder selectively movably disposed in the elongate channel between the first end and the second end, the first holder and the second holder together configured to receive and secure a chain to the main body, wherein the main body further has an elongate raised portion on the inner surface, and an elongate recessed portion on the outer surface, the elongate recessed portion disposed opposite the elongate raised portion, the elongate channel formed through the elongate raised portion to the elongate recessed portion, and the main body also has a rectilinear hole formed therethrough from the elongate raised portion to the elongate recessed portion, the rectilinear hole spaced apart from the first end of the elongate channel, wherein the first holder includes a first roller and a first shaft, the first shaft disposed through the first roller and through the rectilinear hole of the main body, and the first shaft connecting the first roller to the main body, the first shaft having a first shaft head with a first rectilinear portion and a first base portion, the first shaft threadably attached to a first knob disposed adjacent to the first roller, and upon tightening of the first knob the first holder is fixedly attached to the main body, and the first rectilinear portion is disposed within the rectilinear hole, thereby militating against a rotation of the first shaft during the tightening or a loosening of the first knob, and the first base portion has a first perimeter edge that circumscribes the first rectilinear portion of the first shaft, the first base portion disposed adjacent to the outer surface of the main body inside of the elongate recessed portion, wherein the second holder includes a second roller and a second shaft, the second shaft disposed through the second roller and through the elongate channel, the second shaft having a second shaft head with a second rectilinear portion and a second base portion, the second rectilinear portion disposed within the elongate channel and militating against a rotation of the second shaft but permitting movement of the second shaft along the elongate channel, and the second base portion having a perimeter edge that circumscribes the second rectilinear portion, the second base portion disposed adjacent the outer surface of the main body and inside of the elongate recessed portion, and the second shaft threadably attached to a second knob disposed adjacent to the second roller, and upon a loosening of the second knob the second roller is movable between the first end and the second end of the elongate channel, and upon a tightening of the second knob the second roller is not movable between the first end and the second end of the elongate channel, whereby the second holder is selectively movable relative to the first holder to accommodate different lengths of the chain;

providing the chain having a first portion and a second portion;

disposing the first portion of the chain on the first holder;

disposing the second portion of the chain on the second holder;

moving the second holder in the elongate channel until the chain is pulled taut between the first holder and the second holder;

selectively affixing the second holder to the main body to thereby secure the chain.

* * * * *